US009193503B2

(12) United States Patent
White et al.

(10) Patent No.: US 9,193,503 B2
(45) Date of Patent: Nov. 24, 2015

(54) BEVERAGE CONTAINER WITH AUDIO CONTROL AND SPEAKER

(71) Applicant: DUBGEAR INC., Etobicoke (CA)

(72) Inventors: Jansen Leslie White, Etobicoke (CA); John Paul Schmider, Etobicoke (CA); Jonathan Paul Loudon, Toronto (CA); Heather Chi-Ying Lam, Toronto (CA)

(73) Assignee: DUBGEAR INC., Etobicoke (CA)

( * ) Notice: Subject to any disclaimer, the term of this patent is extended or adjusted under 35 U.S.C. 154(b) by 0 days.

(21) Appl. No.: 14/134,287

(22) Filed: Dec. 19, 2013

(65) Prior Publication Data

US 2014/0174964 A1 Jun. 26, 2014

Related U.S. Application Data

(60) Provisional application No. 61/740,601, filed on Dec. 21, 2012.

(51) Int. Cl.

| | |
|---|---|
| ***B65D 25/20*** | (2006.01) |
| ***A47G 23/02*** | (2006.01) |
| ***A47G 19/22*** | (2006.01) |

(52) U.S. Cl.

CPC ..... *B65D 25/20* (2013.01); *A47G 19/2227* (2013.01); *A47G 23/02* (2013.01); *A47G 2019/2244* (2013.01)

(58) Field of Classification Search

CPC ..... B65D 25/20; A47G 19/2227; A47G 19/2244; A47G 23/02; A47G 2019/2244; H05K 11/00

USPC ..... 206/217, 218; 220/212.5, 694, 703, 220/710.5; 446/74, 397; 340/612, 613, 692; 455/66.1, 344, 346–348, 350, 575.1

See application file for complete search history.

(56) References Cited

U.S. PATENT DOCUMENTS

| | | | | |
|---|---|---|---|---|
| 5,070,539 | A * | 12/1991 | Cheng | 455/344 |
| 5,536,196 | A * | 7/1996 | Sternberg | 206/217 |
| 6,483,440 | B1 * | 11/2002 | Welch | 455/344 |
| 6,505,734 | B2 * | 1/2003 | Su | 206/217 |
| 6,648,725 | B2 * | 11/2003 | Chan | 446/479 |
| 6,778,813 | B1 * | 8/2004 | Lilly | 455/90.3 |
| 8,344,902 | B2 * | 1/2013 | Chen | 340/692 |
| 8,550,288 | B2 * | 10/2013 | Briar et al. | 220/664 |
| 8,631,942 | B2 * | 1/2014 | Levy et al. | 206/542 |
| 8,876,166 | B2 * | 11/2014 | Brewster et al. | 283/56 |
| 2007/0060017 | A1 * | 3/2007 | Klusmeyer et al. | 446/397 |
| 2009/0114554 | A1 * | 5/2009 | Earnest | 206/217 |

FOREIGN PATENT DOCUMENTS

| | | | |
|---|---|---|---|
| WO | WO 03013959 | A2 * | 2/2003 |
| WO | WO 2007033026 | A1 * | 3/2007 |
| WO | WO 2011100783 | A1 * | 8/2011 |

* cited by examiner

*Primary Examiner* — Bryon Gehman

(74) *Attorney, Agent, or Firm* — Bhole IP Law; Anil Bhole

(57) ABSTRACT

A beverage container is provided. The beverage container includes an audio speaker and/or an audio control. The audio control is located on a handle near the location a person's thumb would be when holding the beverage container. The speaker is located near the base of the beverage container to provide optimal weight balancing.

10 Claims, 6 Drawing Sheets

BEVERAGE CONTAINER WITH AUDIO CONTROL AND SPEAKER

TECHNICAL FIELD

The following relates generally to a beverage container and more specifically to a beverage container having an audio control and speaker.

BACKGROUND

Portable devices are becoming ever more available. These portable devices include portable electronic devices, such as smart phones and accessories for smart phones. Smart phones are commonly used as music playback devices.

There are various scenarios in which a user wishes to play music while in remote locations.

SUMMARY

In one aspect, a beverage container is provided, the beverage container comprising an audio speaker, circuitry sufficient to drive the audio speaker, an audio input and a control to control the audio input or an external device linked to the audio input, the audio speaker being disposed within the beverage container to permit the beverage container to be biased to an upright position, the control being disposed along a portion of the beverage container corresponding to the location a person's thumb would typically be placed when holding the beverage container.

BRIEF DESCRIPTION OF THE DRAWINGS

The features of the invention will become more apparent in the following detailed description in which reference is made to the appended drawings wherein.

DETAILED DESCRIPTION

Figure 1:
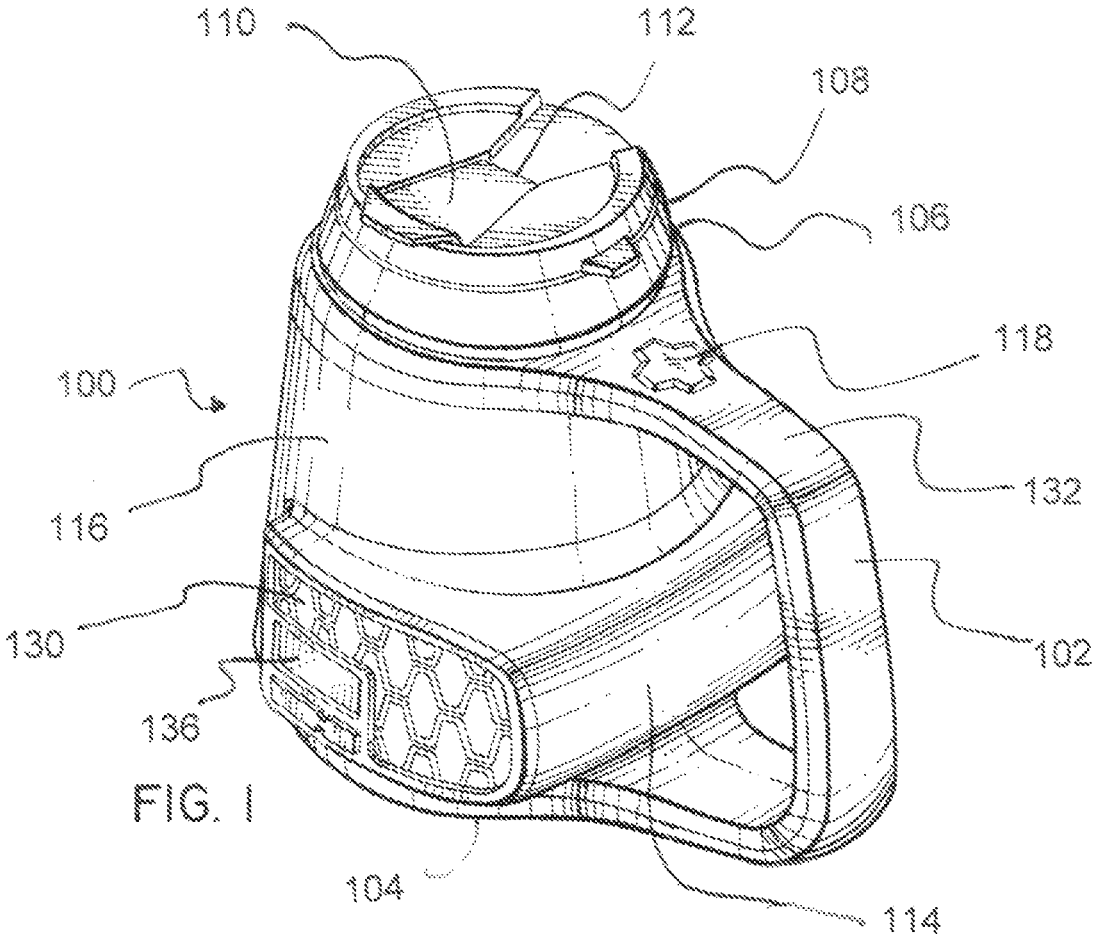
FIG. 1 is a front perspective view of a beverage container with audio control and speaker.

Embodiments will now be described with reference to the figures. It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

In one aspect, a beverage container having an audio control and speaker is provided. The control may be disposed along a handle of the beverage container such that a person holding the beverage container by its handle can easily operate the control with her thumb. The speaker may be disposed within the beverage container to optimize the weight balance of the beverage container.

Referring now to FIG. 1, an exemplary beverage container (100) is shown. The beverage container (100) is shown as a stein, but it will be appreciated that any form of beverage container may be provided, including a tumbler, wine glass, vessel, etc. In some embodiments, however, the beverage container (100) comprises a handle (102) extending from the base (104) of the beverage container (100) toward the top (106) of the beverage container (100). The top (106) of the beverage container (100) may be capped by a lid (108), which may have a stopper (110) or other mechanism suitable to prevent egress of liquid from the beverage container (100). Such a lid (108) is generally desirable when the beverage container is used while travelling, driving, etc. The stopper (110) is typically moveable to permit egress of liquid from the beverage container (100) using a hinge (112), a slide mechanism, rotation mechanism, etc. as is known.

The beverage container (100) comprises one or more speaker (114) and electronic circuitry suitable for linking the one or more speaker (114) by wire or wireless communication to an audio device (not shown). In an example, a wired connection may be provided by an audio input (e.g., analog stereo connector) and/or Universal Serial Bus input. The audio device may further comprise a radio tuner and antenna.

In an example, the audio device is a BlueTooth™-equipped smart phone and the beverage container (100) is also BlueTooth-equipped. That is, the electronic circuitry provides BlueTooth functionality. The beverage container (100) and audio device can be "paired" such that the beverage container (100) may be used to control audio playback from the audio device resulting in the transmission of an audio signal from the audio device to the beverage container (100). Pairing of BlueTooth devices can be accomplished by known means and is not explained in detail herein. It will be appreciated that the transmission of the audio signal between the audio device and the beverage container (100) could be by any other suitable technique. In embodiments, the portable device (100) may further comprise a microphone.

The electronic circuitry may be sufficient to generate audio output given the audio signal and, optionally, digitize an audio signal given audio input from the microphone.

The one or more speaker (114) output sound. The one or more speaker (114) may be housed within the beverage container. One or more sound ports may be provided in the audio device to enable sound generated by the one or more speaker (114) to escape the beverage container. At least a portion of the exterior surface may comprise a speaker grill (130) or other apertures (e.g., perforations) disposed adjacent each speaker (114) for sound to escape the beverage container (100).

The handle (102) extends away from the body (116) of the beverage container by a distance suitable to permit a person's hand to fit therebetween. This may be on the order of inches.

A control (118) is disposed on an exterior surface of the beverage container (100) to control the electronic circuitry, including providing commands to control the audio device.

Figure 2:
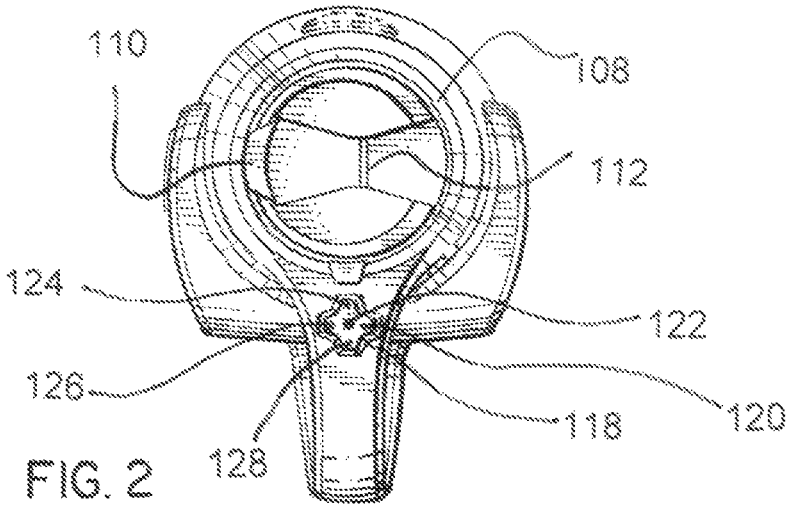
FIG. 2 is a top view of the beverage container.
Figure 3:
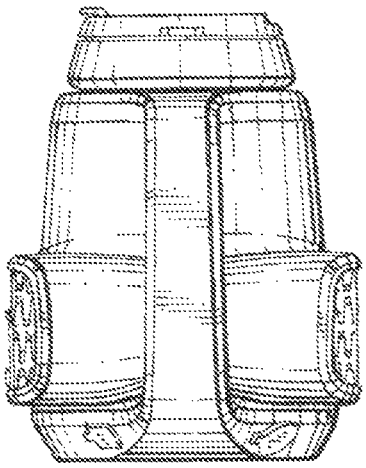
FIG. 3 is a rear view of the beverage container.
Figure 4:
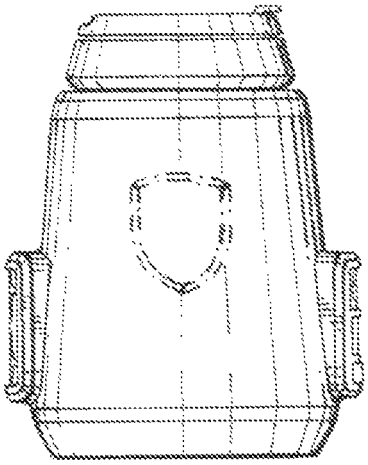
FIG. 4 is a front view of the beverage container.
Figure 5:
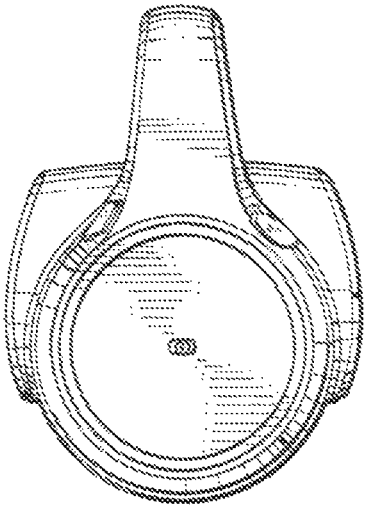
FIG. 5 is a bottom view of the beverage container.

Referring now to FIG. 2, the control (118) may comprise a plurality of buttons. Alternatively, as shown, the control is a five command switch cluster (e.g. with rubber membrane over top), which can be depressed along four directions (120, 124, 126, 128) and at its center (122). The five commands may comprise any suitable command to the audio device including, for example, power on/off, BlueTooth pairing, fast forward, next track, rewind, previous track, pause, play, stop, volume up and volume down, call answer, initiate call, or further commands and/or a subset thereof. Additional commands may be configured by associating patterns of commands (e.g., pressing the left command (126) followed by the right command (120) or a short press of left (126) being differentiated from a long press of the left command (120), or combinations of the foregoing with any of the commands).

It will therefore be appreciated that by operation of the control (118) to control the electronic circuitry, a person can command the audio device to output audio, such as music, from the one or more speaker (114) such that it is audible through the speaker grill (130).

In one aspect, the control (118) is disposed along the handle (102). The control (118) may be disposed along a portion of the handle (102) that would typically correspond to the location that a person's thumb would be placed when holding the beverage container (100). In such a location, the control (118) is easily operated by the person without jeopardizing the person's grip on the beverage container (100) as the person moves her thumb. This prevents stress on the person's hand and wrist while minimizing the opportunity of spillage, even when operating the control (118).

Figure 6:
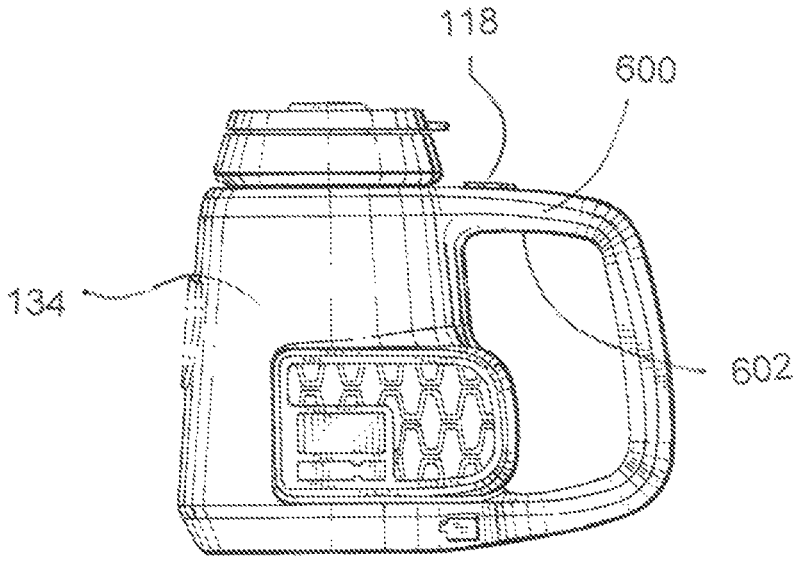
FIG. 6 is a side view of the beverage container.
Figure 7:
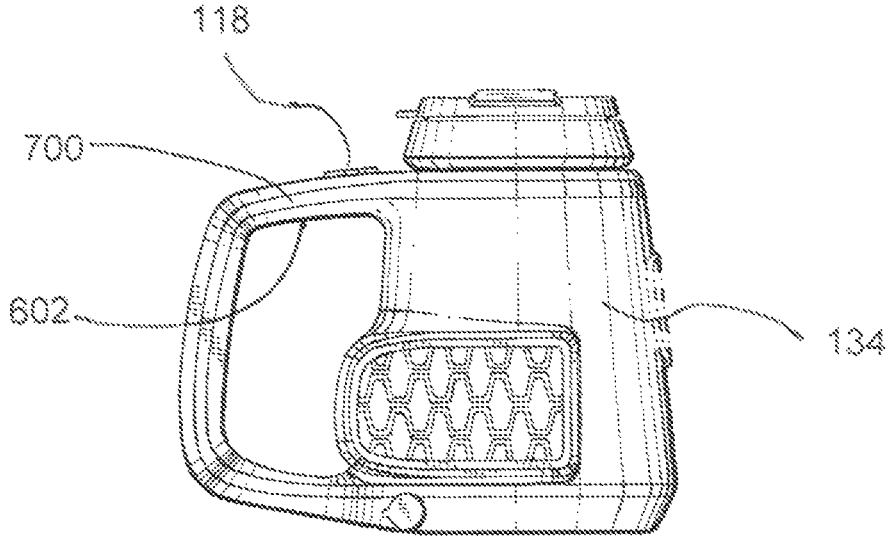
FIG. 7 is an opposing side view of the beverage container.

Referring to FIGS. 6 and 7, the control (118) is shown as being disposed on a top surface (132) of the handle (102), however the control may alternatively be disposed along a side surface (600, 700) or bottom surface (602) thereof, or could comprise commands dispersed along one or more of the surfaces (132, 600, 700, 602).

In another aspect, the speaker (114) is disposed within the beverage container (100) so as to render the beverage container (100) as having a weight distribution wherein it is heavier near its base (104) than near its top (106). The speaker (114) may be disposed along a side (134) of the beverage container (100) and proximate the base (104) of the beverage container (100). This orientation enables the beverage container to naturally stand upright when held by a person, preventing spillage when in movement.

In particular embodiments, the beverage container may further comprise a visual output device (138) (display), such as an LED or LCD screen, to provide visual feedback to a user. Visual feedback may comprise display of tuned radio station, current track name and elapsed or remaining time, current mode (BlueTooth, telephone control, wired input, radio), battery power, etc.

Figure 8:
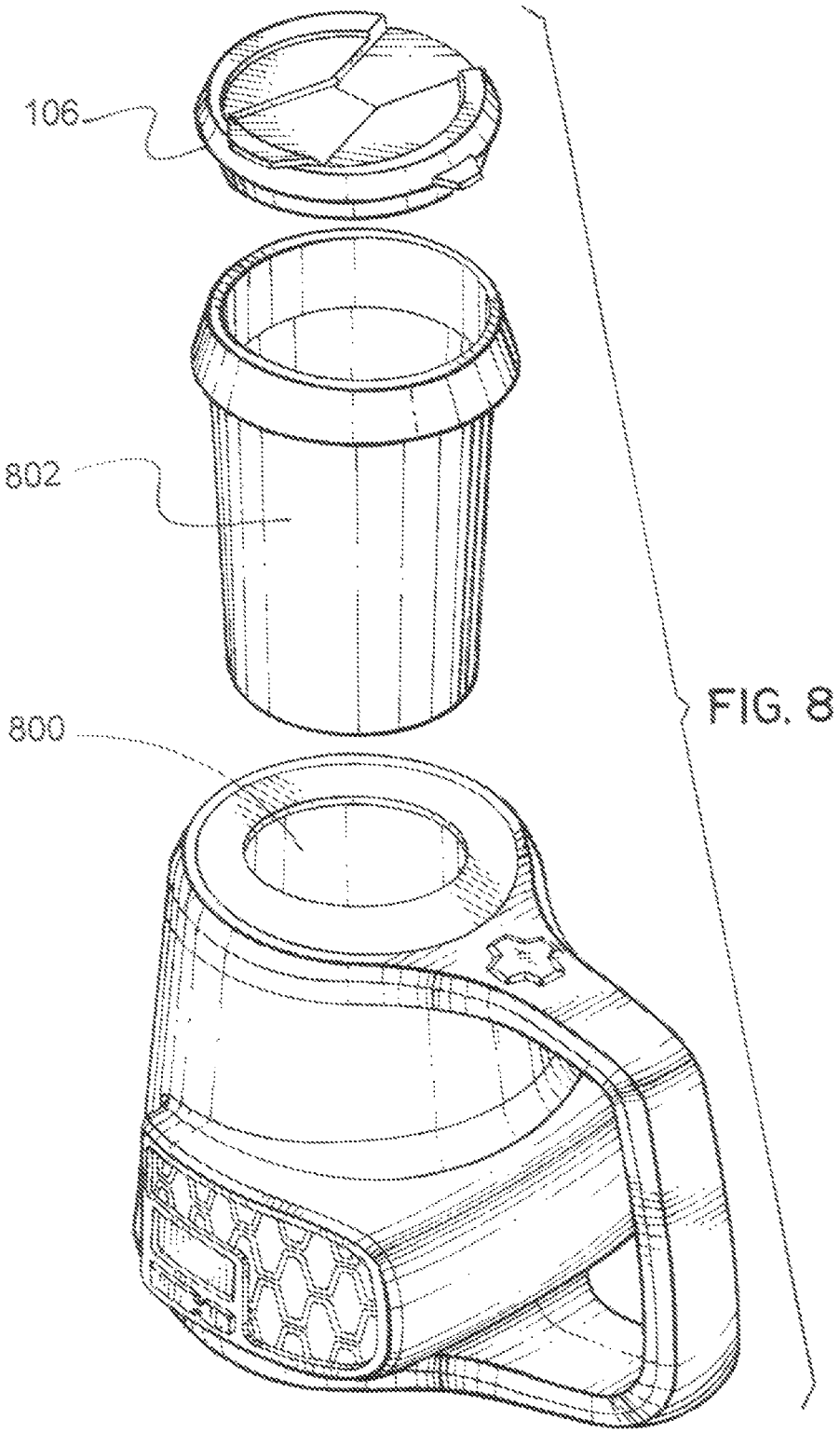
FIG. 8 is an exploded front perspective view of one embodiment of the beverage container.
Figure 9:
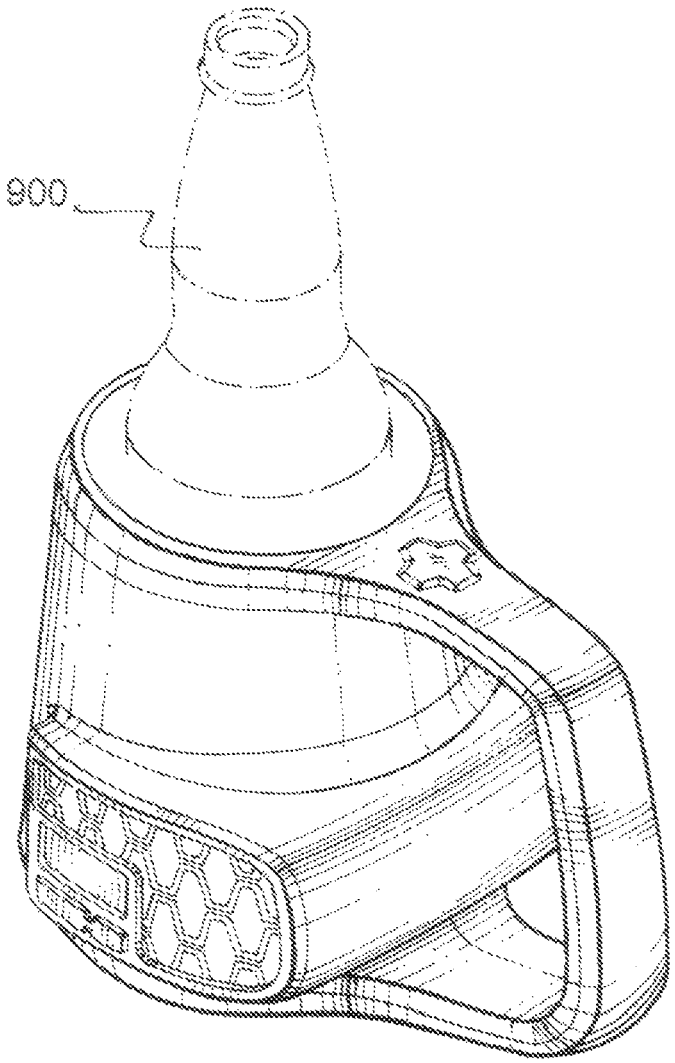
FIG. 9 is a front perspective view of another embodiment of the beverage container.
Figure 10:
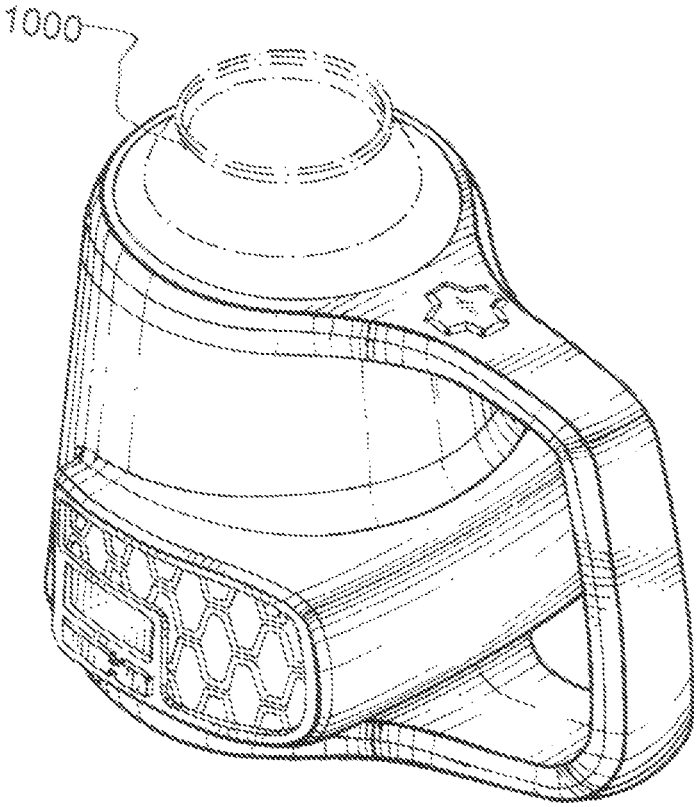
FIG. 10 is a front perspective view of yet another embodiment of the beverage container.

Referring now to FIGS. 8 to 10, embodiments of the beverage container are described. In one embodiment, the beverage container has a cavity (800). In an embodiment, the cavity (800) is suitably dimensioned to accommodate a liquid beverage directly therein, a cup insert (802), a bottle (900), a beverage can (1000) or other suitable secondary container. The cup insert (802) may comprise a locking mechanism to couple the cup insert (802) to a corresponding locking mechanism of the lid (106). Two particular examples of locking mechanisms include a threading on each of the cup insert (802) and lid (106), and a snap-fit between the cup insert (802) and lid (106).

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

The invention claimed is:

1. A beverage container, the beverage container comprising a cavity for containing a beverage, electronic circuitry linkable to an external paired audio device using a short range wireless audio communication interface, a pair of audio speakers disposed to emit sound in substantially opposing directions from side walls of the beverage container, the side walls being tapered such that a base of the beverage container has a larger area than a top surface of the beverage container, circuitry sufficient to drive the audio speakers, an audio input, and a control to control the audio input or the external paired audio device, the audio speakers being disposed along the side walls and proximate the base of the beverage container to permit the beverage container to be biased to an upright position and so that the beverage container is heavier near its base than near its top surface, and the control being disposed along a surface of a handle of the beverage container between an outermost portion of the handle and the cavity, the handle being spaced evenly between the pair of audio speakers and disposed approximately transversely to the substantially opposing directions.

2. The beverage container of claim 1, further comprising one or more sound ports to permit sound generated from the audio speakers to escape the beverage container.

3. The beverage container of claim 1, wherein the control is a switch.

4. The beverage container of claim 3, wherein the switch is a five command switch.

5. The beverage container of claim 1, wherein the control is configured to control power, external pairing of the audio device, next track, previous track, pause, play, stop, volume up and volume down, call and answer.

6. The beverage container of claim 1, wherein the handle extends from substantially the base of the beverage container to substantially the top surface of the beverage container.

7. The beverage container of claim 6, wherein the handle comprises a bottom portion co-planar to the bottom surface and wherein the audio speakers are disposed above a bottom portion of the handle.

8. The beverage container of claim 1, wherein the control comprises a plurality of commands disposed along a plurality of surfaces of the handle.

9. The beverage container of claim 1, further comprising a display.

10. The beverage container of claim 1, wherein the cavity further accommodates one of a cup insert, a beverage bottle and a beverage can.

* * * * *